United States Patent [19]

Janniere et al.

[11] Patent Number: 4,868,535

[45] Date of Patent: Sep. 19, 1989

[54] MINIATURIZED THERMAL CONTACT BREAKER FOR PRINTED CIRCUIT BOARD

[75] Inventors: Alain Janniere, Paris; Jean-Pierre Teisseire, Orchamps, both of France

[73] Assignee: ITT Industries, Inc., New York, N.Y.

[21] Appl. No.: 267,045

[22] Filed: Nov. 3, 1988

[30] Foreign Application Priority Data

Nov. 12, 1987 [FR] France ..... 87 15642

[51] Int. Cl.[4] ..... H01H 71/16

[52] U.S. Cl. ..... 337/68; 337/66; 337/91

[58] Field of Search ..... 337/68, 91, 66

[56] References Cited

U.S. PATENT DOCUMENTS 3,321,597 5/1967 Meijer .
3,361,888 1/1968 Brackett .
4,068,203 1/1978 Unger ..... 337/56

FOREIGN PATENT DOCUMENTS 3333986 3/1984 Fed. Rep. of Germany .
2543734 3/1983 France .
657434 11/1949 United Kingdom .
2110002 6/1983 United Kingdom .

*Primary Examiner*—H. Broome
*Attorney, Agent, or Firm*—Thomas L. Peterson

[57] ABSTRACT

The invention relates to a contact breaker of the type that includes a slider (22, FIG. 1) that slides longitudinally within a housing to allow a moving contact 50 (FIG. 3) on a sudden actin bimetal strip (44) to pass through a slider opening (62) against a fixed contact (40), or to keep the contacts apart after they have briefly moved apart. The state of the contact breaker is indicated by a signalling electrical circuit which includes a moving contact (80, FIG. 1) mounted on the slider and having a pair of clips that connect coplanar signalling contacts (68, 70). The slider has a lower extension (92, FIG. 4) that prevents arcing between power contacts. The housing includes two half-casings (16, 18, FIG. 7) joined at a longitudinal joint 19, one carrying power terminals (32, 34) and the other carrying signalling terminals (74, 76). The slider keeps the contacts (50, 40, FIG. 3) separate even if the front housing surface is blocked.

9 Claims, 4 Drawing Sheets

MINIATURIZED THERMAL CONTACT BREAKER FOR PRINTED CIRCUIT BOARD

BACKGROUND OF THE INVENTION

The subject of the present invention is a thermal contact breaker for printed circuit board.

U.S. Pat. No. 3,321,597 describes a thermal contact breaker of the type including a slider within a housing. A sudden action bimetal strip above the slider, is connected to a terminal of a power circuit, and bears a moving contact. A fixed contact lying opposite the moveable one, is connected to the second terminal of the power circuit. The slider includes a window through which the moving contact can extend to contact the fixed contact and axially immobilize the slider. Excessive current through the bimetal strip causes it to lift the moveable contact and allow the slider to move to its tripped position under the force of a spring. The slider then prevents engagement of the contacts.

The contact breaker described in the above patent is desirable especially because it is of the free tripping type, in that the power circuit continues to be protected even when the reset button is held in its engaged position. However, the contact breaker is too large to allow it to be fitted to printed circuit boards in mass production, and its structure does not permit easy fitting thereof.

U.S. Pat. No. 4,068,203 describes a thermal contact breaker of the same type in which the slider separates the housing into two longitudinal chambers inside one of which is arranged a bimetal strip of the Taylor type described generally in the document GB-B-657,434 which produces excellent tripping performance in the case of overvoltage. However, this U.S. patent describes a contact breaker of very large size which does not allow its inclusion on a printed circuit board and whose internal structure is particularly complex and costly to produce.

The document FR-A-2,543,734 describes a thermal contact breaker of small size for printed circuit boards which includes two fixed terminals of a power circuit as well as a fixed contact of a signaling circuit. However, the signaling circuit is not electrically isolated from the power circuit since it uses one terminal of the latter in the case of tripping of the contact breaker. In addition, unlike the device described in the first two documents mentioned above, this contact breaker is not of the free tripping type.

SUMMARY OF THE INVENTION

The present invention proposes a thermal contact breaker for a printed circuit board which includes an electrical circuit signaling the tripping of the contact breaker, which is electrically isolated from the power circuit. The signaling circuit includes two fixed contacts longitudinally spaced in the housing, and a moving contact mounted on the slider for connecting the fixed signalling contacts. The fixed signaling contacts include two coplanar metallic strips, and the moving contact is in the form of a contact with a pair of resilient clips that can contact the coplanar strips to electrically connect them. The slider can include a transverse wall at its rear end that prevents arcing between the separated contacts.

The assembly and production of a contact breaker of this type of very small size is made possible particularly by the fact that the housing can be formed by two half-casings. The half-casings are separated by a longitudinal plane perpendicular to the lower surface of the contact breaker which bears on the printed circuit board, and covered by a cover. One of the two half-casings holds the two fixed signaling contacts and the other holds the two terminals of the power circuit.

The final connection between the two half-casings and the cover can be provided by means of a layer of adhesive and sealing coating applied to the lower surface of the contact breaker. This layer protects all of the internal components of the contact breaker from intrusions of flux during the operation of soldering the contact breaker onto a printed circuit board, for example by means of a so-called "wave" soldering process.

In addition, the contact breaker can be made "washable" by the positioning, before the soldering and washing operations, of removable adhesive tape which blocks the opening formed in the cover. The adhesive tape must normally be removed before putting the contact breaker into operation. However, if the user should forget to remove the tape, the length of the slider, including a reset button at its forward end, is such that it allows a protected opening of the power circuit in the presence of the adhesive tape.

Other characteristics and advantages of the invention will appear on reading the detailed description which follows which will be understood by referring to the appended drawings.

DESCRIPTION OF THE PREFERRED EMBODIMENT

Figure 1:
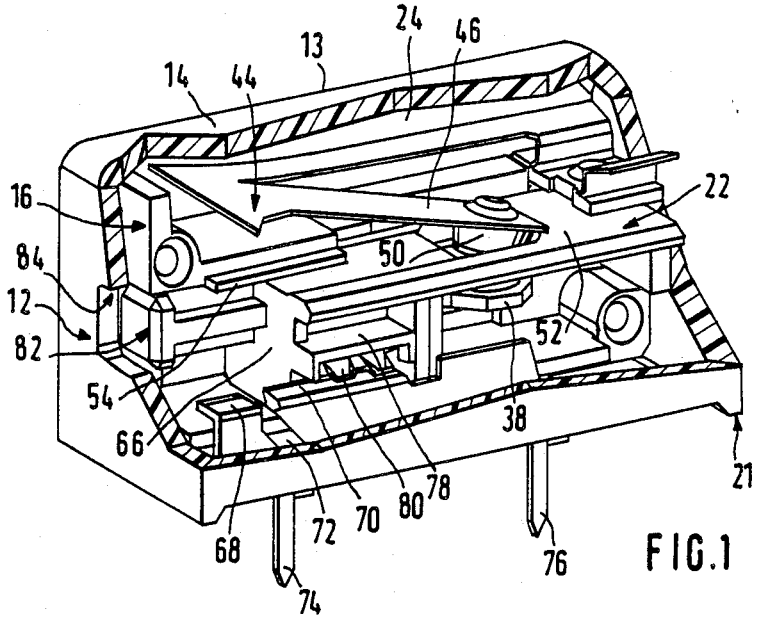
FIG. 1 is a perspective view of a contact breaker produced according to the teaching of the present invention, of which part of the cover and of the casing have been removed, and which is shown in the engaged or closed position.

FIG. 1 shows a contact breaker 12 which has a housing 13 that includes an enclosure or cover 14 that encloses a contact breaker casing part formed by molded half-casings 16 and 18 (FIG. 6) joined at longitudinal joints 19, 21 as by adhesive. The contact breaker has a lower surface 20 (FIG. 7) designed to be supported on a printed circuit board by projecting feet 21'.

A slider 22 (FIG. 4) of generally elongated flat shape with upper and lower opposite sides, divides the internal space formed by the two half-casings into an upper chamber 24 and a lower chamber. The lower chamber is itself divided into two longitudinal cavities 26 and 28 by a transverse partition 30 essentially formed in the half-casing 16.

Figure 7:
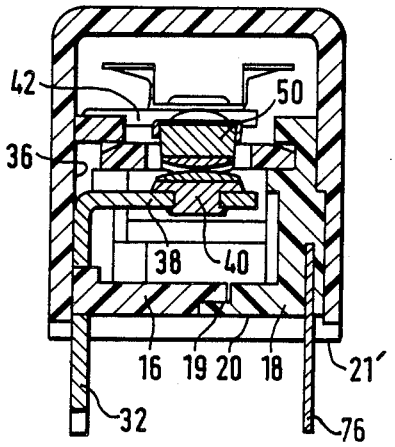
Figure 8:
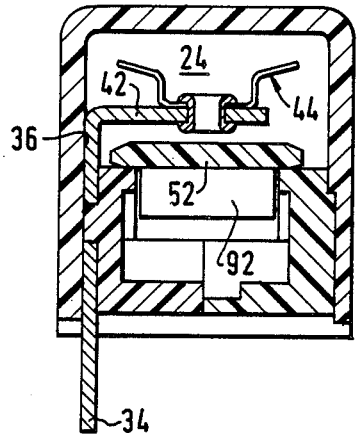

The half-casing 16 (FIG. 7) receives terminals 32 and 34 that connect to an electrical power circuit, which the contact breaker must protect. The first terminal 32 extends along a lateral surface 36 and then extends inside the second longitudinal cavity 28 (FIG. 3) by means of a transverse pad 38 folded at 90°, which supports a fixed contact 40 of the power circuit. Similarly, the power terminal 34 (FIG. 8) extends vertically along the face 36 of the half-casing 16 to the inside of the upper chamber 24. The power terminal 34 has a transverse pad 42, folded at 90°, which supports a thermal bimetal strip device 44. The strip device or strip 44 is fixed to the pad 42 by a metal rivet. The thermal bimetal strip 44 has a substantially rectangular general profile with a U-shaped slot (shown in FIG. 2) forming a bistable distortable arm 46 (FIG. 3) which has a free end that includes a moving bimetal contact 50 of the power circuit.

Figure 6:
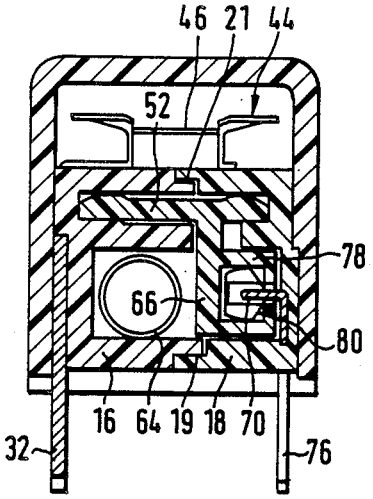

The slider 22, constructed of electrically insulative material as are the half-casings 16 and 18 and the cover 14, forms a rectangular plate 52 whose edges slide between the half-casings 16, 18 (FIG. 6). The plate-shaped portion 52 of the slider includes a rectangular window or opening 62 (FIG. 3) through which the moving contact 50 extends to contact the fixed contact 40 and close the power circuit through terminals 32 and 34. The slider can slide longitudinally in a forward direction F to its tripped or open position shown in FIG. 4, and in a rearward direction R to its engaged or closed position shown in FIG. 3. A coil spring 64 urges the slider in the forward direction. In the engaged position, the moving contact 50 is in contact with the rear edge of slider window 62, which prevents the slider from moving in the forward direction under the force of the spring 64. In the tripped position a separating portion, formed by the rear of slider portion 52, lies between the contacts.

In order to allow the miniaturization of the contact breaker, the spring 64 is a compression coil spring arranged inside the first lower longitudinal cavity 26. The rear end of the spring bears on the partition 30, and the forward end of the spring bears against a lower extension 66 of the slider which projects inside the first longitudinal cavity 26.

The contact breaker includes two fixed contacts 68 and 70 (FIG. 1) of a contact breaker tripping signaling circuit. The two fixed signaling contacts 68 and 70 include coplanar metal strips that are longitudinally spaced from each other, with a gap 72 between them. The contacts 68, 70 include connection terminals 74 and 76 accessible from outside the casing.

The lower extension 66 (FIG. 1) of the slider 22 includes a lateral extension 78 which holds a moving signalling contact 80 with individually deflectable forward and rearward clips. In the closed or engaged position (FIG. 1) both clips of contact 80 engage signaling contact 70. In the open or tripped position (FIG. 2) the more forward clip of contact 80 has passed over gap 72 and engages contact 68, while the more rearward clip of contact 80 engages contact 70, to connect the terminals 74 and 76 of the contact breaker tripping signaling circuit.

Figure 2:
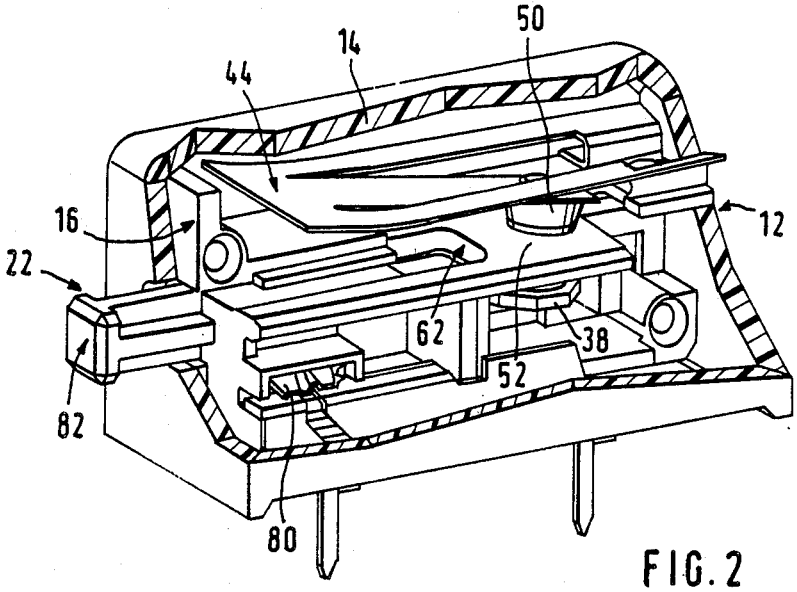
FIG. 2 is a view similar to that of FIG. 1, with the contact breaker in its tripped or open position.

The slider 22 includes a reset button 82 at the forward end of the slider. The reset button 82 is aligned with openings 84 and 86 (FIG. 9) in the two half-casings 16 and 18 and in the cover 14. In the tripped position of the contact breaker, the button 82 projects outward through the openings 84 and 86 as can be seen in FIGS. 2 and 4.

Figure 5:
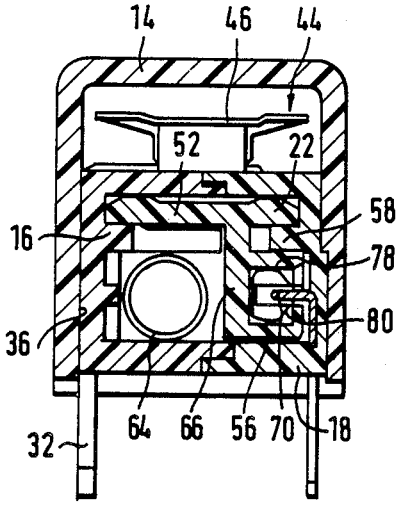
FIGS. 5, 6, 7 and 8 are transverse sectional views along lines 5—5, 6—6, 7—7 and 8—8 of FIG. 3.

While the half-casing 16 (FIG. 7) receives the power terminals 32, 34, the right casing 18 receives the signaling terminals 74, 76. The slider (FIG. 5) can be installed between the half-casings 16, 18 and the assembly moved up into the cover 14 to prevent separation of the half-casings. Interfitting joints 19, 21 (FIG. 6) prevent relative vertical movement of the half-casings. The final fixing of the components of the contact breaker inside the cover 14 and the sealing of the assembly can be provided using a layer of adhesive and sealing coating, not shown in the figure, which is spread on the lower bearing surface 20 of the contact breaker 12.

Figure 9:
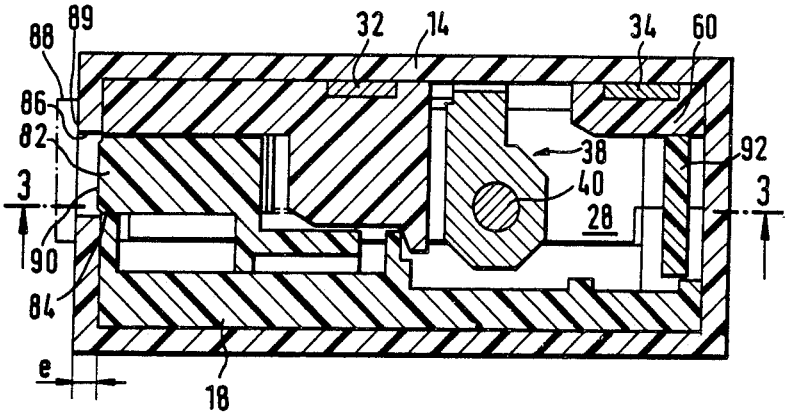
FIG. 9 is a sectional view along line 9—9 of FIG. 3.
Figure 10:
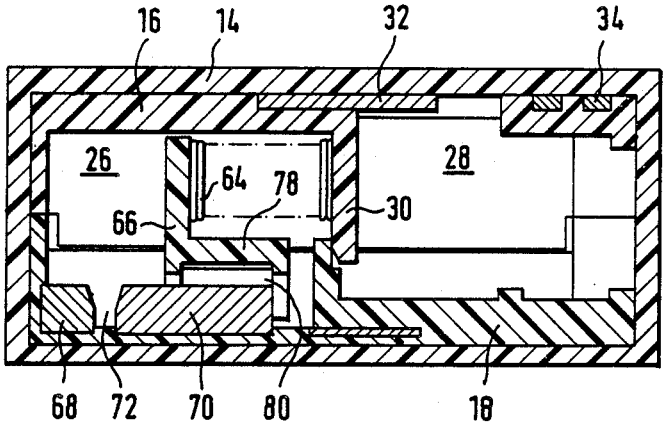
FIG. 10 is a sectional view along line 10 of FIG. 3.

In order to complete this sealing, and in particular to allow a washing operation after soldering, the contact breaker 12 can be provided with a length of adhesive tape 88 shown in phantom lines in FIG. 9 on the housing front surface 89, which will block the opening 86 of the cover 14. The adhesive tape 88 must of course be removed from the contact breaker after the washing operation. However, in order to ensure greater safety for the user in case the tape is left on, the slider can move far enough to keep the contacts 40, 50 open even if the tape is left on. For this purpose, the length of button 82 is chosen in combination with the thickness "e" of the cover 14, to allow sufficient forward travel of the slider 22 until the front surface 90 of the button 82 abuts the portion of adhesive tape 88, to keep the contacts 40, 50 separate. That is, when the button abuts the adhesive tape, a portion of the slider lies under contact 50. When the slider is in its engaged position, the button front surface lies rearward of the housing front surface.

Figure 3:
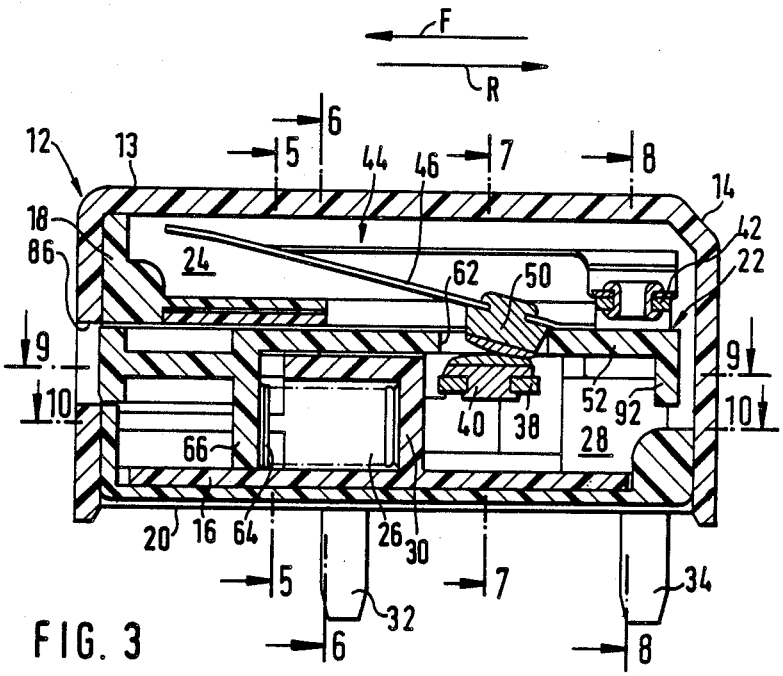
FIG. 3 is a longitudinal sectional view of the contact breaker of FIG. 1, showing a view taken on line 3—3 of FIG. 9, the contact breaker being shown in its engaged position.
Figure 4:
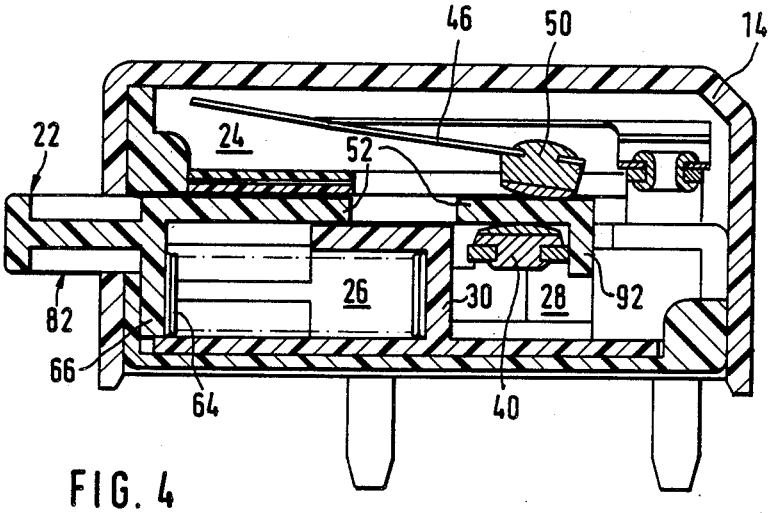
FIG. 4 is a view similar to that of FIG. 3 but with the contact breaker in its tripped position.

As can be seen in FIGS. 3 and 4, the plate 52 of slider 22 includes a second lower extension 92, turned downwards by 90°, at the rear end of the slider. This second extension 92 isolates contacts 40 and 50 of the power circuit in the tripped position, to prevent an electrical arc between these two contacts, in a slider of relatively short length.

The operation of the contact breaker will now be described briefly. With the contact breaker in the closed or engaged position shown in FIG. 3, the flow of excess power current between terminals 32, 34 results in heating of the bimetal strip 44. Such heating causes the arm 46 of the strip to distort so its free end and the moving contact 50 on the free end move vertically upwards. During its upward movement the moving contact 50 clears the rear edge of window 62 to allow the sudden forward sliding of the slider 22 under the force of the trip spring 64. The slider 22 moves until the front surface of the lower extension 66 comes into contact with the corresponding surface of the two half-casings 16 and 18 as shown in FIG. 4.

In the tripped position which has just been reached, a separation slider portion formed by the rear of plate 52 lies between the two contacts 40 and 50 of the power circuit. The reset button 82 then projects outside of the enclosure cover 14 in order to permit the manual resetting of the contact breaker 12.

The resetting operation is simply carried out by pressing the reset button 82 towards the rear in opposition to spring 64, until the moving contact 50 again penetrates the window 62 of the slider 22 in order to immobilize the slider. The button may be pressed rearwardly until the rear end at 92 of the slider abuts the rear of the cover. Release of the button allows the slider to move forward slightly until stopped by contact 50.

If the fault which has produced the excess current and tripping of the contact breaker, has not disappeared, resetting by pressing the button 82 will allow contacts 40, 50 to engage only briefly since excess current will cause the contact 50 to move up again. The protection function of the contact breaker therefore continues to be provided even if the resetting device is manually held in the engaged position.

Although particular embodiments of the invention have been described and illustrated herein, it is recognized that modifications and variations may readily occur to those skilled in the art and consequently it is intended to cover such modifications and equivalents.

What is claimed is:

1. A thermal contact breaker comprising:

a housing;

a slider mounted in said housing to slide in forward and rearward directions, said slider having first and second opposite sides;

a first power contact lying on said first side of said slider;

a bimetallic strip device having a second contact which moves against said first contact when the strip is cool and away from said first contact to a location on said second side of said slider when the strip is hot, said device having a portion which can abut said slider when the second contact is against said first contact to prevent forward slider movement;

said slider forming a separating portion which lies between said contacts when said slider is in a forward position, and forming an opening aligned with said contacts when the slider is in a rearward position to allow the contacts to engage each other;

a spring urging said slider in said forward direction;

a pair of signaling contacts (68, 70) mounted on said housing so they are spaced along the direction of slider movement;

a moving contact (80) mounted on said slider to contact both of said signaling contacts when the slider is in one of said positions and to be free of contact with one of said signaling contacts when the slider is in the other of said positions.

2. The contact breaker described in claim 1 wherein:

said pair of signaling contacts includes coplanar rearward and forward contacts with a gap between them;

said moving contact is in the form of a double clip with forward and rearward clips that are individually deflectable, said forward clip positioned so as said slider moves from said rearward position to said forward position said forward clip moves from a position against said rearward signaling contact across said gap to a position against said forward signaling contact.

3. The contact breaker described in claim 1 wherein:

said housing includes a cover (14) and two half-casings (16, 18) in said cover, said signalling contacts (68, 70) mounted in a first (18) of said half-casings, and including a pair of power terminals (32, 34) mounted in said second half-casing (16) and respectively connected to said first contact and to said bimetallic strip device.

4. The contact breaker described in claim 1 wherein:

said housing has a bottom surface (20) and includes two separately molded half-casings (16, 18) joined along said bottom surface along a joint (19)extending primarily in a forward-rearward direction, said slider slideably mounted between said half-casings, said signalling contacts (68, 70) mounted in a first (18) of said half-casings, and including a pair of power terminals (32, 34) mounted in said second half-casing (16) and respectively connected to said first contact and to said bimetallic strip device.

5. A thermal contact breaker comprising:

a housing;

a slider mounted in said housing to slide in forward and rearward directions, said slider having first and second opposite sides;

a first power contact lying on said first side of said slider;

a bimetallic strip device having a second contact which moves against said first contact when the strip is cool and away from said first contact to a location on said second side of said slider when the strip is hot, said device having a portion which can abut said slider when the second contact is against said first contact to prevent forward slider movement;

said slider forming a separating portion which lies between said contacts when said slider is in a forward position, and forming an opening aligned with said contacts when the slider is in a rearward position to allow the contacts to engage each other;

a spring urging said slider in said forward direction;

said slider has a rear end that includes an extension (92) extending primarily perpendicular to said forward and rearward directions to one of said sides of said slider, whereby to avoid arcing between the contacts while using a slider of short length.

6. The contact breaker described in claim 5 including:

a power terminal having a pad (42, FIG. 3) lying rearward of said second terminal, said bimetallic strip having a rearward portion mounted on said pad;

said slider extension (92) extends toward said first side of said slider to lie substantially directly behind said first contact.

7. The contact breaker described in claim 5 wherein:

said housing has a forward surface and said slider has a forward end that forms a button with a forward surface, said slider arranged so its button forward surface lies a distance rearward of said housing forward surface when said slider is in said rearward position, said slider being constructed so when said button forward surface lies even with said housing forward surface a part of said slider separating portion lies against said second contact to prevent it from moving against said first contact.

8. A thermal contact breaker comprising:

a housing;

a slider mounted in said housing to slide in forward and rearward directions, said slider having first and second opposite sides;

a first power contact lying on said first side of said slider;

a bimetallic strip device having a second contact which moves against said first contact when the strip is cool and away from said first contact to a location on said second side of said slider when the strip is hot, said device having a portion which can abut said slider when the second contact is against said first contact to prevent forward slider movement;

said slider forming a separating portion which lies between said contacts when said slider is in a forward position, and forming an opening aligned with said contacts when the slider is in a rearward position to allow the contacts to engage each other;

a spring urging said slider in said forward direction;

said housing having a forward surface and said slider having a forward end that forms a button with a forward surface, said slider arranged so its button forward surface lies a distance rearward of said housing forward surface when said slider is in said rearward position, said slider being constructed so when said button forward surface lies even with said housing forward surface a part of said slider separating portion lies between said second and first contacts.

9. A thermal contact breaker comprising:

a housing;

a slider mounted in said housing to slide in forward and rearward longitudinal directions, said slider having first and second opposite sides;

a first power contact lying on said first side of said slider;

a bimetallic strip device having a second contact which moves against said first contact when the strip is cool and away from said first contact to a location on said second side of said slider when the strip is hot, said device having a portion which can abut said slider when the second contact is against said first contact to prevent forward slider movement;

said slider forming a separating portion which lies between said contacts when said slider is in a forward position, and forming an opening aligned with said contacts when the slider is in a rearward position to allow the contacts to engage each other;

a spring urging said slider in said forward direction;

said housing including two half-casings (16, 18) with longitudinally-extending interfitting joints (19, 21), said slider (22) having opposite edges slideably disposed between said half-casings, and a cover (14) which surrounds said half-casings to keep them together.

* * * * *